US012760383B2

(12) United States Patent
Drillet

(10) Patent No.: US 12,760,383 B2
(45) Date of Patent: Oct. 13, 2026

(54) COLD-ROLLED AND ANNEALED STEEL SHEET AND MANUFACTURING METHOD

(71) Applicant: ArcelorMittal, Luxembourg (LU)

(72) Inventor: Josée Drillet, Rozerieulles (FR)

(73) Assignee: ArcelorMittal, Luxembourg (LU)

( * ) Notice: Subject to any disclaimer, the term of this patent is extended or adjusted under 35 U.S.C. 154(b) by 711 days.

(21) Appl. No.: 17/786,625

(22) PCT Filed: Dec. 18, 2019

(86) PCT No.: PCT/IB2019/061000
§ 371 (c)(1),
(2) Date: Jun. 17, 2022

(87) PCT Pub. No.: WO2021/123880
PCT Pub. Date: Jun. 24, 2021

(65) Prior Publication Data
US 2023/0038535 A1 Feb. 9, 2023

(51) Int. Cl.
*C21D 8/0221* (2026.01)
*C21D 1/26* (2006.01)
*C21D 8/0247* (2026.01)
(Continued)

(52) U.S. Cl.
CPC ..... *C21D 8/0236* (2013.01); *C21D 1/26* (2013.01); *C21D 8/0226* (2013.01);
(Continued)

(58) Field of Classification Search
None
See application file for complete search history.

(56) References Cited

U.S. PATENT DOCUMENTS 4,204,892 A * 5/1980 Economopoulos ..... C21D 1/02 148/590
2002/0007882 A1* 1/2002 Inoue ..... C21D 8/0226 148/541
(Continued)

FOREIGN PATENT DOCUMENTS

EP 2768989 A1 8/2014
JP 2005281854 A * 10/2005
(Continued)

OTHER PUBLICATIONS

Search Report for PCT/IB2019/061000.

*Primary Examiner* — Stephani Hill
(74) *Attorney, Agent, or Firm* — Davidson Kappel LLC

(57) ABSTRACT

A steel sheet has a composition including 0.060%≤C≤0.085%, 1.8%≤Mn≤2.0%, 0.4%≤Cr≤0.6%, 0.1%≤Si≤0.5%, 0.010%≤Nb≤0.025%, 3.42N≤Ti≤0.035%, 0≤Mo≤0.030%, 0.020%≤Al≤0.060%, 0.0012%≤B≤0.0030%, S≤0.005%, P≤0.050%, 0.002%≤N≤0.007% and optionally 0.0005%≤Ca≤0.005%, the remainder of the composition being iron and unavoidable impurities. The microstructure includes 34% to 80% bainite, 10% to 16% martensite, and 10% to 50% ferrite. The surface fraction of unrecrystallized ferrite, with respect to the whole structure, is less than 30%. The martensite includes self-tempered martensite and fresh martensite, the surface fraction of self-tempered martensite being between 4% and 10%.

19 Claims, 2 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C23C 2/06*** | (2006.01) |
| ***C23C 2/40*** | (2006.01) |

(52) U.S. Cl.

CPC ..... *C21D 8/0263* (2013.01); *C21D 8/0273* (2013.01); *C21D 9/46* (2013.01); *C22C 38/001* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C23C 2/06* (2013.01); *C23C 2/40* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2011/0126944 | A1* | 6/2011 | Kami | C21D 6/002 148/333 |
| 2012/0282487 | A1* | 11/2012 | Ogawa | C23C 2/28 148/333 |
| 2016/0160309 | A1 | 6/2016 | Allain et al. | |
| 2018/0171459 | A1 | 6/2018 | Drillet et al. | |
| 2018/0202017 | A1* | 7/2018 | Drillet | C21D 8/0236 |
| 2019/0249282 | A1* | 8/2019 | Nakano | C22C 38/20 |

FOREIGN PATENT DOCUMENTS

| | | | | |
|---|---|---|---|---|
| JP | 2010138458 | A * | 6/2010 | |
| JP | 2011140687 | | 7/2011 | |
| KR | 20160082362 | A | 7/2016 | |
| WO | WO2013037485 | A1 | 3/2013 | |
| WO | WO2015011511 | A1 | 1/2015 | |
| WO | WO-2016198906 | A1 * | 12/2016 | B32B 15/013 |
| WO | WO-2017006144 | A1 * | 1/2017 | B21B 1/22 |

* cited by examiner

COLD-ROLLED AND ANNEALED STEEL SHEET AND MANUFACTURING METHOD

The present disclosure relates to a cold-rolled and annealed steel sheet having a high strength, excellent ductility and formability and an excellent hole expansion ratio. The present disclosure also relates to a method for manufacturing such a cold-rolled and annealed steel sheet.

BACKGROUND

"Dual-phase" steels have experienced major development, since they combine high strength with high drawability, as a result of their microstructure, in which a hard martensitic or bainitic phase is dispersed in a soft ferritic matrix.

Especially, before forming, these steels have a yield strength relatively low as compared to their tensile strength. As a consequence, these steels exhibit a very favorable yield ratio (yield strength/tensile strength ratio) during forming operations.

Their strain hardenability is very high, which allows obtaining a significantly higher yield strength on parts after forming and a good distribution of deformations in the case of a collision. It is thus possible to produce parts as complex as with conventional steels, but with higher mechanical properties, so that the same functional specifications as conventional steels can be met with however a decreased thickness. Thus, these steels provide an effective response to the vehicle lightening and safety requirements.

Especially, owing to their high energy absorption capacity and fatigue strength, dual phase steels are particularly well adapted to produce automotive structural and safety parts such as longitudinal beams, cross members and reinforcements.

The development of automotive parts having shapes with increased complexity has led to increased demand for steels having a very high ductility and formability, especially a very high drawability, together with a high tensile strength, of at least 780 MPa.

To ensure a high ductility and a high drawability, a yield strength of at least 350 MPa but not more than 450 MPa before any temper rolling operation (and at least 450 MPa and not more than 550 MPa after temper rolling, if performed), a total elongation of at least 15% and a hole expansion ratio HER of at least 35% are desirable, in addition to a tensile strength of at least 780 MPa, up to 900 MPa.

The tensile strength TS and the total elongation TE are measured according to ISO standard ISO 6892-1, published in October 2009. It must be emphasized that, due to differences in the methods of measurement, in particular due to differences in the geometries of the specimen used, the values of the total elongation TE according to the ISO 6892-1 standard are very different and are in particular lower than the values of the total elongation according to the JIS Z 2241 standard.

Besides, the yield strength is increased by temper rolling, so that the value of the yield strength of a cold-rolled sheet that has not been subjected to any temper rolling is not comparable to the value of the yield strength of a steel sheet that has been subjected to temper rolling.

In this respect, it must be noted that a steel sheet that has been subjected to temper rolling is clearly different and recognizable from a steel sheet that was not subjected to temper rolling. Indeed, temper rolling has effects on the surface properties of the sheet, especially has a clear and recognized effect on the work hardening and residual strains at the surface of the sheet. Moreover, the temper rolling leaves identifiable unique marks on the surface of the sheet, in the form of roughness craters having a distinct shape. These marks can be easily visualized using an electronic microscope.

The hole expansion ratio HER is measured according to ISO standard 16630:2009. Due to differences in the methods of measure, the values of hole expansion ration HER according to the ISO standard 16630:2009 are very different and not comparable to the values of the hole expansion ratio λ according to the JFS T 1001 (Japan Iron and Steel Federation standard).

The hole expansion ratio evaluates the hole flange stretchability of the steel.

Generally, high values of the hole expansion ratio are associated to high values of the yield ratio (equal to the yield strength divided by tensile strength), and therefore, for a given tensile strength, to high values of the yield strength. Indeed, high values of the hole expansion ratio result in particular from a low difference in strength between the components of the microstructure of the steel. However, a low difference in strength between the components of the microstructure of the steel results in a high yield ratio.

As a consequence, steel sheets having a tensile strength of at least 780 MPa and a high hole expansion ratio will generally have a yield strength higher than 450 MPa, and even higher than 500 MPa before any temper rolling, leading to a yield strength higher than 550 MPa, or even higher than 600 MPa after temper rolling. By contrast, steel sheets having a tensile strength of at least 780 MPa and a yield strength of at most 450 MPa before temper rolling will have a low hole expansion ratio.

SUMMARY

Therefore, it remains desirable to produce a cold-rolled steel sheet having a tensile strength comprised between 780 MPa and 900 MPa, a yield strength comprised between 350 MPa and 450 MPa before any temper rolling (and between 450 MPa and 550 MPa after temper rolling, if performed), a total elongation of at least 15% and a hole expansion ratio of at least 35%.

Therefore, one aim of the present disclosure consists in providing a steel sheet having a tensile strength comprised between 780 MPa and 900 MPa, a yield strength comprised between 350 MPa and 450 MPa before any temper rolling operation (and a yield strength comprised between 450 MPa and 550 MPa after temper rolling, if performed), a total elongation of at least 15% and a hole expansion ratio of at least 35%, and a method for manufacturing the same.

Furthermore, as explained in further details below, the inventors have discovered that adjusting the composition of the steel to obtain these properties is not sufficient, since the known manufacturing methods, applied to a steel having a composition thus designed, lead to a significant inhomogeneity of the mechanical properties in the lengthwise and in the widthwise directions of the sheet.

Therefore, preferably, the present disclosure further aims at providing a steel sheet having the above properties, such that these properties are homogeneous throughout the sheet, and a method for manufacturing such a steel sheet.

Moreover, on a given production line, the hole expansion ratio generally decreases with an increased thickness of the sheet. Hence, the present disclosure also aims at providing a method for manufacturing a cold-rolled steel sheets having the above mechanical properties over a wide range of sheet thickness, from 0.7 mm up to 2.3 mm, for example of at least 1.5 mm or at least 2.0 mm.

For this purpose, the present disclosure relates to a cold-rolled and annealed steel sheet, having a composition comprising, and preferably consisting of, by weight percent:

0.060%≤C≤0.085%
1.8%≤Mn≤2.0%
0.4%≤Cr≤0.6%
0.1%≤Si≤0.5%
0.010%≤Nb≤0.025%
3.42N≤Ti≤0.035%
0≤Mo≤0.030%
0.020%≤Al≤0.060%
0.0012%≤B≤0.0030%
S≤0.005%
P≤0.050%
0.002%≤N≤0.007%
and optionally 0.0005%≤Ca≤0.005%,
the remainder of the composition being iron and unavoidable impurities resulting from the smelting, the cold-rolled and annealed steel sheet having a microstructure consisting of, in surface fraction:
between 34% and 80% of bainite,
between 10% and 16% of martensite, and
between 10% and 50% of ferrite, wherein the surface fraction of unrecrystallized ferrite, with respect to the whole structure, is of less than 30%;
the martensite consisting of self-tempered martensite and fresh martensite, the surface fraction of self-tempered martensite, with respect to the whole structure, being comprised between 4% and 10%.

Preferably, the bainite is low carbide containing bainite, comprising less than 100 carbides per surface unit of 100 $\mu m^2$.

In an embodiment, the cold-rolled and annealed steel sheet is non temper-rolled, the cold-rolled and annealed steel sheet having a tensile strength TS comprised between 780 MPa and 900 MPa, a yield strength YS comprised between 350 MPa and 450 MPa, a total elongation TE of at least 15%, and a hole expansion ratio HER, measured according to the ISO standard 16630:2009, of at least 35%.

In another embodiment, the cold-rolled and annealed steel sheet is a temper-rolled sheet, having a tensile strength TS comprised between 780 MPa and 900 MPa, a yield strength YS comprised between 450 MPa and 550 MPa, a total elongation TE of at least 15%, and a hole expansion ratio HER, measured according to the ISO standard 16630:2009, of at least 35%.

Generally, the cold-rolled and annealed steel sheet has a thickness comprised between 0.7 mm and 2.3 mm, for example of at least 2.0 mm.

Preferably, the cold-rolled and annealed steel sheet has a length, in the rolling direction, of at least 500 m, and the difference in tensile strength between the highest tensile strength regions and the lowest tensile strength regions of the cold-rolled and annealed steel sheet is of at most 7% of the tensile strength of the highest tensile strength regions.

In an embodiment, the cold-rolled and annealed steel sheet comprises a zinc or zinc alloy coating, obtained through continuous dip coating.

In another embodiment, the cold-rolled and annealed steel sheet comprises a zinc or zinc alloy coating, obtained through vacuum deposition.

The present disclosure also relates to a method for manufacturing a cold-rolled and annealed steel sheet, comprising the following successive steps:

providing a semi-product made of a steel having a composition comprising, and preferably consisting of, by weight percent:
0.060%≤C≤0.085%
1.8%≤Mn≤2.0%
0.4%≤Cr≤0.6%
0.1%≤Si≤0.5%
0.010%≤Nb≤0.025%
3.42N≤Ti≤0.035%
0≤Mo≤0.030%
0.020%≤Al≤0.060%
0.0012%≤B≤0.0030%
S≤0.005%
P≤0.050%
0.002%≤N≤0.007%
and optionally 0.0005%≤Ca≤0.005%,
the remainder of the composition being iron and unavoidable impurities resulting from the smelting,
heating said semi-product to a temperature $T_{H1}$ higher than or equal to 1200° C. then hot-rolling the heated semi-product, with a final rolling temperature $T_{FRT}$ comprised between Ar3 and $T_{NR}$, Ar3 being the temperature of beginning of transformation of the austenite upon cooling of the steel and $T_{NR}$ being the non-recrystallization temperature of the steel, to obtain a hot-rolled steel sheet,
cooling the hot-rolled steel sheet at a first cooling rate $V_{C1}$ of at least 10° C./s to a coiling temperature $T_{coil}$ higher than the martensite finish temperature Mf of the steel and lower than 500° C., and coiling the hot-rolled steel sheet at the coiling temperature $T_{coil}$, to obtain a structure consisting of bainite and optionally martensite and/or pearlite, a surface fraction of pearlite being lower than 15%,
cold-rolling the hot-rolled steel sheet with a cold-rolling reduction ratio of at least 40% to obtain a cold-rolled steel sheet,
reheating the cold-rolled steel sheet to an annealing temperature $T_{H2}$ comprised between Ac3-20° C. and Ac3+15° C., with an average heating rate $V_H$ to the annealing temperature $T_{H2}$ comprised between 1° C./s and 50° C./s and an average heating rate $V_{H'}$ between 600° C. and Ac1 comprised between 1° C./s and 10° C./s, and holding the cold-rolled steel sheet at the annealing temperature $T_{H2}$ for an annealing time $t_{H2}$ of at least 30 s, so as to obtain a structure comprising at least 50% of austenite,
cooling the cold-rolled steel sheet to a temperature $T_C$ comprised between 440° C. and 480° C., at a second cooling rate $V_{C2}$ comprised between 10° C./s and 50° C./s,
holding the cold-rolled steel sheet in a temperature range comprised between 440° C. and 480° C. for a holding time $t_c$ comprised between 20 s and 500 s,
cooling the cold-rolled steel sheet to ambient temperature at a third cooling rate $V_{C3}$ of at least 1° C./s.

Preferably, the annealing time $t_{H2}$ is of at most 500 s.

In an embodiment, the annealing temperature $T_{H2}$ is comprised between Ac3 and Ac3+15° C. and the second cooling rate $V_{C2}$ is comprised between 10° C./s and 20° C./s.

Generally, the cold-rolled and annealed steel sheet has a microstructure consisting of, in surface fraction:
between 34% and 80% of bainite,
between 10% and 16% of martensite, and
between 10% and 50% of ferrite, wherein the surface fraction of unrecrystallized ferrite, with respect to the whole structure, is of less than 30%;

the martensite consisting of self-tempered martensite and fresh martensite, the surface fraction of self-tempered martensite, with respect to the whole structure, being comprised between 4% and 10%.

In an embodiment, during said holding in the temperature range comprised between 440° C. and 480° C., the cold-rolled steel sheet is hot-dip coated in a bath at a temperature lower than or equal to 480° C.

Preferably, the cold-rolled and annealed steel sheet is coated with Zn or a Zn alloy.

In another embodiment, after cooling down to ambient temperature, a zinc or zinc alloy coating is performed by vacuum deposition.

Preferably, the cold-rolling reduction ratio is comprised between 40% and 80%.

In an embodiment, after cooling down to the ambient temperature, the steel sheet is temper-rolled with a temper rolling ratio comprised between 0.1 and 0.4%.

BRIEF SUMMARY OF THE DRAWINGS

The present disclosure will now be described in details but without introducing limitations, with reference to the appended Figures, amongst which.

DETAILED DESCRIPTION

Figure 1:
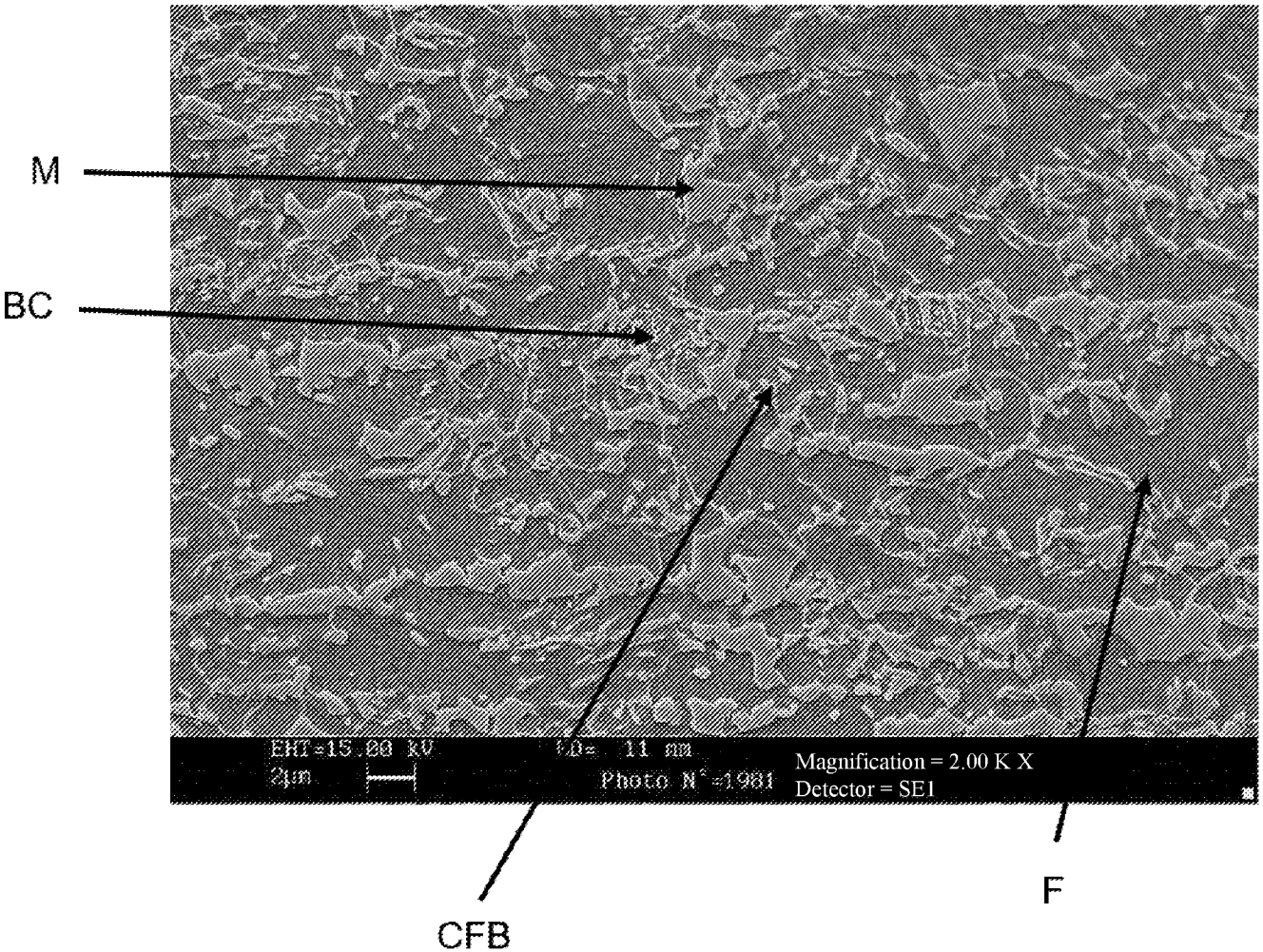
FIG. 1 is a micrograph showing the structure of a steel sheet not in accordance with the present disclosure.

Throughout the application, Ac1 designates the beginning of allotropic transformation temperature upon heating.

Ac1 can be measured by dilatometry, or evaluated with the following equation, published in «Darstellung der Umwandlungen für technische Anwendungen and Moglichkeiten ihrer Beeinflussung», H. P. Hougardy, Werkstoffkunde Stahl Band 1,198-231, Verlag Stahleisen, Dusseldorf, 1984:

$$Ac1=739-22*C-7*Mn+2*Si+14*Cr+13*Mo-13*Ni.$$

In this equation, Ac1 is expressed in degrees Celsius, and C, Mn, Si, Cr, Mo and Ni designate the contents in C, Mn, Si, Cr, Mo and Ni in the composition, expressed by weight percent.

Furthermore, Ar3 designates the beginning of transformation temperature of the austenite upon cooling, $T_{NR}$ designates the non-recrystallization temperature of the steel and Ac3 designates the end of austenitic transformation temperature upon heating.

The temperatures Ar3 and Ac3 can be measured by dilatometry, or evaluated with the Thermo-Calc® software, known in itself. The non-recrystallization temperature $T_{NR}$ can be measured by a torsion test.

Besides, Mf designates the martensite finish temperature, i.e. the temperature at which the transformation from austenite to martensite finishes upon cooling. Mf can be measured by dilatometry.

In the following, the contents in the element of the chemical composition of the steel are expressed by weight percent (or by parts by million, i.e. ppm).

In the chemical composition of the steel, carbon plays a role in the formation of the microstructure and in the mechanical properties.

The carbon content is comprised between 0.060% and 0.085% for ensuring a tensile strength of at least 780 MPa, a yield strength comprised between 350 MPa and 450 MPa before any temper rolling (and 450 MPa and 550 MPa after temper rolling) and a hole expansion ratio of at least 35%. If the C content is lower than 0.060%, the tensile strength does not reach 780 MPa. If the C content is higher than 0.085%, a too high fraction of pearlite forms during the coiling, leading to a banded structure, detrimental to the hole expansion ratio. Besides, the bainite comprises a too high amount of carbides so that the yield strength may exceed 450 MPa (before temper rolling) and the total elongation may not reach 15%. Preferably, the C content is lower than or equal to 0.075%.

At least 1.8% of manganese and at least 0.4% of chromium are added to increase the quenchability of the steel, in order to obtain a microstructure containing at least 10% of martensite and having a tensile strength of at least 780 MPa.

In particular, the Mn content is of at least 1.8% to obtain a sufficient quenchability. However, if the Mn content is higher than 2.0%, the stabilization of the austenite is too important and the Ms temperature is too high, so that a too high martensite fraction will form during the cooling from the annealing temperature. As a result, the yield strength will exceed 450 MPa (before temper rolling). Besides, a Mn content higher than 2.0% leads to a banded structure, detrimental to the hole expansion ratio. As a result, the hole expansion ratio does not reach 35%.

Unlike manganese, chromium does not impact the fraction of austenite during the annealing. Therefore, chromium is added in addition to Mn to further increase the quenchability of the steel, a Cr content of at least 0.4% together with a Mn content of at least 1.8% providing sufficient quenchability to obtain a tensile strength of at least 780 MPa. Indeed, below 0.4%, the fractions of self-tempered martensite may be insufficient, whilst a too high ferrite fraction may be obtained. Above 0.6% of Cr, the coatability of the steel is reduced and the cost of the addition is excessive. Therefore, the Cr content is of at most 0.6%.

In a content of at least 0.1%, silicon provides hardening of the ferrite, thus decreasing the difference in hardness between the constituents of the microstructure and increasing the hole expansion ratio. The silicon favors the formation of low carbide containing bainite, i.e. comprising less than 100 carbides per surface unit of 100 $\mu m^2$. However, an excessive Si reduces the coatability by promoting the formation of oxides adhering to the surface of the sheet, and leads to a too important stabilization of the ferrite. Therefore, the Si content is of at most 0.5%.

Titanium and niobium are micro-alloying elements used together according to the present disclosure to provide precipitation hardening and allow achieving a tensile strength of at least 780 MPa whilst limiting the martensite fraction to at most 16%.

In a content between 3.42*N and 0.035% (N designating the N content in the steel, expressed by weight percent), titanium combines mainly with nitrogen and carbon to precipitate in the form of fine nitrides and/or carbonitrides, which allow controlling the austenite grain size. The titanium also has a positive influence on the weldability of the steel. If the titanium content is above 0.035%, there is a risk of forming coarse titanium nitrides precipitated from the liquid state, which tend to reduce the ductility and lead to early damage during the hole expansion test, thus reducing the hole expansion ratio.

In this content, titanium ensures that the nitrogen is fully combined in the form of nitrides or carbonitrides, such that the boron is in free form and may play an effective role in the hardenability.

In a content of at least 0.010%, niobium is very effective for forming fine niobium carbonitrides during the annealing in a temperature range near the intercritical transformation range, leading to precipitation hardening. Furthermore, Nb refines the austenitic grains and thus limits the pearlite fraction in the hot-rolled sheet further to coiling. If the Nb content is below 0.010%, the austenitic grain size will be too large, so that the final structure will comprise too much self-tempered martensite. As a result, the yield strength will be too large. However, above 0.025%, niobium excessively delays the recrystallization of the ferrite during the annealing, so that the structure will comprise more than 30% unrecrystallized ferrite, which no longer makes it possible to achieve the targeted hole expansion ratio.

At least 0.0012% of boron is added to limit the activity of carbon, so as to control and limit the diffusive phase transformations (pearlite transformation during cooling) and to form hardening phases (bainite or martensite) required for obtaining the desired tensile strength. The addition of B also makes it possible to limit the addition of hardening elements such as Mn, Mo, and Cr and to reduce the cost of the steel grade. However, above 0.0030%, B may co-segregate with C, leading to the formation of banded structures detrimental for the hole expansion ratio. Therefore, the B content is of at most 0.0030%. Preferably, the B content is of at least 0.0015%, and/or of at most 0.0025%.

The composition may comprise up to 0.030% of molybdenum as a residual element. Mo delays the precipitation of Nb and Ti during the annealing and delays recrystallization and may cause an excessive refining of the ferrite grains if present in a content higher than 0.030%.

Aluminum is a very effective element for deoxidizing the steel in the liquid phase during elaboration. The Al content is of at least 0.020% in order to obtain a sufficient deoxidization of the steel. The Al content must however be of at most 0.060% to avoid an increase in the temperature Ac3 and to allow controlling the formation of ferrite during cooling.

In order to form a satisfactory quantity of nitrides and carbonitrides, a minimum nitrogen content of 0.002% is required. The nitrogen content is limited to 0.007% to prevent the formation of coarse TiN precipitates from the liquid state, which tend to reduce the ductility and lead to early damage during the hole expansion test, reducing the hole expansion ratio.

Optionally, the steel may undergo a treatment for globularization of sulfides performed with calcium, which has the effect of improving the hole expansion ratio, due to MnS globularization. Hence, the steel composition may comprise at least 0.0005% of Ca, up to 0.005%.

The remainder of the composition of the steel is iron and impurities resulting from the smelting. In this respect, nickel, copper, sulfur and phosphorus are considered as residual elements which are unavoidable impurities. Therefore, their contents are at most 0.05% Ni, at most 0.03% Cu, at most 0.005% S and at most 0.050% P.

If the sulfur content is above 0.005%, due to the presence of excess sulfides such as MnS, the ductility, in particular the hole expansion ratio, is reduced. Achieving a very low S content, i.e. lower than 0.0001%, is very costly, and without any benefit. Therefore, the S content is generally higher than or equal to 0.0001%.

However, in the present disclosure, the sensitivity of the hole expansion ratio with respect to the S content of the steel is reduced, so that a hole expansion ratio of at least 35% can be obtained even with S contents above 0.001%, which are less costly to obtain. Consequently, according to an embodiment, the S content is of at least 0.001%.

Phosphorus is an element which reduces the spot weldability and the hot ductility, particularly due to its tendency to segregate at the grain boundaries and co-segregate with manganese. For these reasons, its content must be limited to at most 0.050%, and preferably at most 0.015%. Achieving a very low P content, i.e. lower than 0.001%, is however very costly. Therefore, the P content is generally higher than or equal to 0.001%.

The microstructure of the cold-rolled and annealed steel sheet according to the present disclosure consists of, in surface fraction, between 34% and 80% of bainite, between 10% and 16% of martensite and between 10% and 50% of ferrite.

A ferrite fraction of at least 10% contributes to achieving a total elongation of at least 15%.

The ferrite may consist of intercritical ferrite, or may comprise intercritical ferrite and ferrite formed upon cooling during the annealing of the cold-rolled steel sheet, as described below. The ferrite created upon cooling is hereinafter called "transformation ferrite". Especially, if the annealing temperature $T_{H2}$ in the process of the present disclosure, as detailed above, is lower than Ac3, i.e. comprised between Ac3-20° C. and Ac3, the ferrite comprises intercritical ferrite and may further comprise transformation ferrite. In other words, if the annealing temperature $T_{H2}$ is lower than Ac3, the ferrite consists of intercritical ferrite or consists of intercritical ferrite and transformation ferrite.

By contrast, if the annealing temperature $T_{H2}$ is higher than or equal to Ac3, the ferrite consists of transformation ferrite.

The "transformation ferrite" is different from the intercritical ferrite which remains in the structure at the end of the annealing step. In particular, the transformation ferrite is enriched in manganese, i.e. has a manganese content which is higher than the average manganese content of the steel, and higher than the manganese content of the intercritical ferrite. The intercritical ferrite and the transformation ferrite can therefore be differentiated by observing a micrograph with a FEG-TEM microscope using secondary electrons, after etching with metabisulfite. On the micrograph, the intercritical ferrite appears in medium grey, whereas the transformation ferrite appears in dark grey, owing to its higher manganese content.

Some of the ferrite may be unrecrystallized. In other words, the ferrite may comprise unrecrystallized ferrite. However, the structure must comprise (in surface fraction) less than 30% of unrecrystallized ferrite. This percentage is expressed with reference to the whole structure.

Having less than 30% of unrecrystallized ferrite is critical to achieve the targeted mechanical properties, especially a hole expansion ratio of at least 35%. Indeed, if the structure comprises more than 30% of unrecrystallized ferrite, then a banded structure is achieved, so that the hole expansion ratio will not reach 35%.

Preferably, the surface fraction of unrecrystallized ferrite is of at most 25%, still preferably of at most 20%.

The martensite results from the transformation without diffusion of the austenite below the Ms temperature upon cooling. The martensite is generally under the form of islands.

A martensite fraction of at least 10% is necessary to obtain a tensile strength of at least 780 MPa. However, owing to the high yield strength of the martensite, a martensite fraction higher than 16% would lead to a yield strength higher than 450 MPa before temper rolling and higher than 550 MPa after temper rolling. Furthermore, a martensite fraction higher than 16% would deteriorate the hole expansion ratio. Therefore, the martensite fraction is of at most 16%.

The martensite consists of self-tempered martensite and optionally fresh martensite (i.e. not tempered nor self-tempered).

The surface fraction of self-tempered martensite, with respect to the whole structure, is comprised between 4% and 10%. Especially, a surface fraction of self-tempered martensite higher than 10% would lead to a yield strength higher than 450 MPa before temper rolling (and higher than 550 MPa after temper rolling if performed).

Furthermore, having 10 to 16% of martensite, with a surface fraction of self-tempered martensite comprised between 4% and 10% contributes to achieving a yield strength of at least 350 MPa but not more than 450 MPa before any temper rolling and a hole expansion ratio HER of at least 35%.

For self-tempered martensite, the definition refers to the one given in "Les principes de base de traitement thermique des aciers" by A. Constant and G. Henry, PYC Edition 1986, p.157.

The martensite generally has a C content lower than 0.75%.

A bainite fraction of at least 34% contributes to achieving a yield strength comprised between 350 MPa and 450 MPa before temper rolling and a hole expansion ratio of at least 35%. Indeed, the yield strength of the bainite is lower than the yield strength of the martensite. Furthermore, the difference in hardness between the bainite and the ferrite is low, and bainite, by fractioning the martensite islands, contributes to avoiding the formation of banded structure and improving the hole expansion ratio.

If the bainite fraction is higher than 80%, the structure will not contain at least 10% of martensite and at least 10% of ferrite, so that the tensile strength or the total elongation will be too low.

Bainite is formed during the cooling from the fully austenitic or the intercritical temperature domain, above the Ms temperature. Bainite assumes the form of an aggregate of bainitic laths and cementite particles. Its formation involves a short-distance diffusion.

A distinction will be made below between carbide containing bainite and low carbide containing bainite.

Low carbide containing bainite refers to bainite containing less than 100 carbides per surface unit of 100 $\mu m^2$. Low carbide containing bainite is formed, during cooling, between 550° C. and 450° C.

Unlike low carbide containing bainite, carbide containing bainite always comprises more than 100 carbides per surface unit of 100 square micrometers.

Preferably, the bainite in the structure is constituted by low carbide containing bainite. Having only low carbide containing bainite contributes to achieving a yield strength of at most 450 MPa before temper rolling and a total elongation of at least 15%.

The structure of the sheet does not comprise any austenite.

These microstructural features are for example determined by observing the microstructure with a Scanning Electron Microscopy using a field effect barrel ("SEM-FEB" technique) with a magnification greater than 1200×, coupled to an EBSD ("Electron Backscatter Diffraction") detector. The morphologies of the laths and grains are next determined by image analysis using programs known in themselves, for example the Aphelion® program.

The fraction of unrecrystallized ferrite is determined by observing the microstructure with a Scanning Electron Microscopy after chemical polishing with a solution composed of hydrofluoric acid and hydrogen peroxide.

The cold-rolled and annealed steel sheet generally comprises fine titanium and/or niobium carbonitrides. Especially, the surface density of these carbonitrides whose largest dimension is lower than 5 nm is preferably lower than or equal to $10^4/\mu m^2$. Here, the largest dimension of the carbonitrides refers to the maximum Feret diameter of the carbonitrides.

This surface density can be measured by observing a sample through transmission electron microscopy (TEM).

The cold-rolled and annealed steel sheet is for example manufactured by a method comprising the following successive steps.

A steel having the composition as mentioned above is cast so as to obtain a steel semi-product. The steel may be cast to obtain an ingot or continuously under the form of a slab, having a thickness of about 200 mm. At this stage, the semi-product comprises (TiNb)(CN) precipitates.

The steel semi-product is reheated to a temperature $T_{H1}$ of at least 1200° C., so as to reach at every point a temperature favorable for the large deformations that the steel will undergo during rolling. During the heating, the (TiNb)(CN) precipitates are dissolved.

The semi-finished product is hot-rolled in a temperature range in which the structure of the steel is fully austenitic, the final rolling temperature $T_{FRT}$ being comprised between the temperature Ar3 and the non-recrystallization temperature $T_{NR}$, to obtain a hot-rolled steel sheet.

If $T_{FRT}$ is lower than Ar3, ferrite grains are created under Ar3 before the end of the rolling. These grains are strain hardened during the rolling and the ductility is reduced.

If $T_{FRT}$ is higher than $T_{NR}$, iron borocarbides $Fe_{23}(BC)6$ will precipitate at the grain boundaries, thereby inhibiting the hardening effect of B. Indeed, these precipitates would not dissolve in the subsequent steps of the manufacturing method.

Generally, the final rolling temperature $T_{FRT}$ is comprised between 850° C. and 930° C.

During the hot-rolling, fine titanium nitrides generally precipitate. Their largest dimension is generally comprised between 150 nm and 200 nm.

The hot-rolled steel product is then cooled at a first cooling rate $V_{C1}$ of at least 10° C./s to a coiling temperature $T_{coil}$ lower than 500° C., and coiled.

The first cooling rate $V_{C1}$ is of at least 10° C./s to avoid transformation of the austenite into ferrite and pearlite upon cooling and to avoid partial niobium precipitation.

The coiling temperature $T_{coil}$ must be lower than 500° C. and higher than the martensite finish temperature Mf.

Indeed, the inventors have discovered that if the coiling temperature $T_{coil}$ is higher than or equal to 500° C., the mechanical properties of the sheet are inhomogeneous in the lengthwise and in the widthwise direction, and the tensile strength does not reach 780 MPa, and is even lower than 600 MPa, at least in some parts of the sheet.

The inventors have investigated this phenomenon and discovered that it is caused notably by the low Mn content in the steel which is necessary to obtain a yield strength of at most 450 MPa before temper rolling and a hole expansion ratio of at least 35%.

Especially, Mn generally delays the transformation of austenite to bainite and/or martensite during the coiling. This is in particular the case for steels having a Mn content higher than 2.0%, in which a yield strength of at most 450 MPa before temper rolling or at most 550 MPa after temper rolling is not required and/or the hole expansion ratio is low.

When the Mn content is decreased to at most 2.0%, the transformation of austenite to bainite during the coiling is accelerated, leading to an increase in temperature of the sheet during the coiling, especially in the core and axis region of the coil.

The core of the coil is defined as the portion of the sheet which extends, along the longitudinal direction of the sheet, from a first end located at 30% of the overall length of the sheet, to a second end located at 70% of the overall length of the sheet. Besides, the axis region is defined as the region centered on the longitudinal middle axis of the sheet, having a width equal to 60% of the overall width of the sheet.

In the core and axis region, during the coiling, the windings are contiguous, so that the heat generated by the transformation of austenite to bainite cannot be dissipated to a large extent.

If the coiling temperature is higher than or equal to 500° C., this increase in temperature leads to the precipitation of borocarbides and coarse titanium and niobium carbides thereby inhibiting the precipitation hardening potential of B, Ti and Nb. In addition, the effect of Nb on recrystallization refining is inhibited, so that the ferrite grains are too coarse. Besides, this increase in temperature results in a coalescence of the cementite. In particular, the cementite is not entirely dissolved, so that the amount of C available for austenite is too low. Hence, a too low amount of austenite is formed in the region located in core and axis region of the coil during the coiling, leading to a too low martensite fraction in this region in the final microstructure. As a result of these two effects, the tensile strength does not reach 780 MPa in this region of the sheet.

In addition, if the coiling temperature is higher than or equal to 500° C., the mechanical properties of the sheet are not homogeneous in the lengthwise nor in the widthwise direction of the sheet.

The inventors have found that when the coiling is performed at a temperature lower than 500° C., despite the increase in temperature due to the transformation of austenite into bainite, no coalescence of the cementite and no precipitation of borocarbides or coarse titanium and niobium carbides appear. Therefore, the tensile strength is not reduced and the mechanical properties of the sheet are homogeneous in the lengthwise and in the widthwise direction of the sheet.

In addition, coiling at a temperature lower than 500° C. allows limiting the fraction of pearlite formed during the coiling, thereby avoiding the formation of a banded structure detrimental to the hole expansion ratio in the subsequent steps of the process.

However, if the coiling temperature is below Mf, the steel will be too hard to cold-roll.

Preferably, the coiling temperature is of at least 300° C., still preferably of at least 350° C. or at least 400° C.

During the coiling, the austenite transforms into bainite, and optionally martensite and/or pearlite, so that at the end of the coiling, the structure of the whole sheet consists of bainite and optionally martensite and/or pearlite, the surface fraction of pearlite being lower than 15%, without ferrite. Especially, the structure is homogeneous in the lengthwise and in the widthwise directions of the sheet. The bainite is low carbide containing bainite, i.e. comprises less than 100 carbides per surface unit of 100 $\mu m^2$.

At this stage, the sheet comprises B, Nb and Ti in solid solution. Especially, the Nb content in solid solution is of at least 0.01%.

This microstructure of the hot-rolled sheet after coiling is critical to obtain the desired mechanical properties. Indeed, the kinetics of recrystallization during the subsequent annealing step, which depends on the microstructure of the hot-rolled sheet after coiling, has a strong influence on the structure formed during the annealing, especially on the size and the shape of the austenite grains. Especially, if the structure of the sheet after coiling comprises 15% or more of pearlite, austenite will mainly nucleate and grow during the annealing in the regions of the sheet comprising pearlite, leading to a banded structure.

The hot-rolled steel sheet is then cold-rolled to obtain a cold-rolled steel sheet, with a cold-rolling reduction ratio of at least 40%. Below 40%, the strain imparted to the structure is insufficient, leading to an insufficient recrystallization during the subsequent annealing and to a banded structure.

The cold-rolling reduction ratio is generally comprised between 40% and 80%.

The cold-rolled steel sheet generally has a thickness comprised between 0.7 mm and 2.3 mm, for example of at least 1.5 mm or at least 2.0 mm.

The cold-rolled steel sheet is then reheated to an annealing temperature $T_{H2}$ comprised between Ac3−20° C. and Ac3+15° C.

The average heating rate $V_H$ to the annealing temperature $T_{H2}$ is comprised between 1° C./s and 50° C./s. Furthermore, the average heating rate $V_H'$ between 600° C. and Ac1 is comprised between 1° C./s and 10° C./s.

It must be noted that the average heating rate $V_H$ between 600° C. and Ac1 is different from the average heating rate between the start of the heating process (e.g. room temperature) and Ac1, and also different from the average heating rate $V_H$ to the annealing temperature $T_{H2}$.

The average heating rates $V_H$ and $V_H'$ are for example achieved by heating the cold-rolled sheet in a continuous annealing furnace having a plurality of zones through which the sheet travels. In each of these zones of the furnace, the settings of the furnace (e.g. temperature in the zone, heating power . . . ) are controlled so as to achieve a specific targeted heating rate in this zone. This control makes it possible to achieve an average heating rate $V_H$ to the annealing temperature comprised between 1° C./s and 50° C./s and an average heating rate $V_H'$ between 600° C. and Ac1 comprised between 1° C./s and 10° C./s.

During the heating between 600° C. and Act the recrystallization occurs and fine titanium and niobium carbonitrides precipitate in the steel. Having fine precipitates makes it possible to still have sufficient Nb in solid solution for controlling the size of the ferrite grains during recrystallization by avoiding a too important growth of the ferrite grains.

The inventors have found that controlling the average heating rate $V_H'$ between 600° C. and Act and thus the heating time between 600° C. and Act which corresponds to the time between the beginning of recrystallization and the end of recrystallization, is critical for the kinetics of the later phase transformations, in particular during the subsequent holding phase at the annealing temperature $T_{H2}$.

In particular, the control of the average heating rate between 600° C. and Ac1 allows controlling the size and the aspect ratio of the ferrite grains obtained at Act During the subsequent heating from Ac1 to the annealing temperature, the austenite grains will nucleate at the grain boundaries of the recrystallized ferrite. Therefore, the control of the average heating rate between 600° C. and Ac1 allows controlling the size and the repartition of the austenite grains at the end of the annealing, and the final microstructure.

An average heating rate $V_H'$ lower than 1° C./s would lead to an excessively long heating time between 600° C. and Ac1, and therefore an excessive growth of the ferrite grains and of the austenite grains subsequently formed. An excessive size of the austenite grains leads to the formation of a too high fraction of martensite during the further steps of the manufacturing method, especially a too high fraction of self-tempered martensite in the final structure. As a result, the yield strength will be too high.

To the contrary, an average heating rate $V_H'$ higher than 10° C./s would lead to an insufficient recrystallization, or event absence of recrystallization of the ferrite during the heating from 600° C. to Ac1. As a result, the austenite nucleates in the regions enriched in carbon, i.e. in the bands of pearlite and martensite, so that the final structure has a banded structure, detrimental to the hole expansion ratio.

An average heating rate $V_H'$ between 600° C. and Ac1 comprised between 1° C./s and 10° C./s makes it possible, at the end of the manufacturing method, to obtain a steel whose microstructure consists of, in surface fraction, between 34% and 80% of bainite, between 10% and 16% of martensite, and between 10% and 50% of ferrite, such that the surface fraction of unrecrystallized ferrite in the structure is of less than 30%, the fraction of self-tempered martensite being comprised between 4% and 10%.

The annealing temperature $T_{H2}$ is comprised between Ac3−20° C. and Ac3+15° C. to obtain, at the end of the holding at the annealing temperature $T_{H2}$, a structure consisting of at least 50% of austenite and optionally ferrite.

If the annealing temperature $T_{H2}$ is lower than Ac3−20° C., the structure may comprise too much ferrite, and/or not enough bainite and/or self-tempered martensite, and the hole expansion ratio HER will not reach 35%.

If the annealing temperature $T_{H2}$ is higher than Ac3+15° C., the size of the austenite grains will be too large. This excessive size of the austenite grains leads to the formation of a too high fraction of bainite and a too high fraction of self-tempered martensite in the final structure, whilst an insufficient fraction of ferrite will be created upon cooling. As a result, the yield strength will be too high and the total elongation will be too low.

The sheet is held at the annealing temperature $T_{H2}$ for an annealing time $t_{H2}$ of at least 30 s, and preferably of at most 500 s. During this holding at the annealing temperature $T_{H2}$, the austenite grains grow and the precipitation of the titanium and niobium carbonitrides continues.

If the annealing time $t_{H2}$ is lower than 30 s, the austenite grains are too small. As a consequence, the final structure comprises an insufficient martensite fraction and an excessive ferrite fraction, so that a tensile strength of at least 780 MPa is not achieved. If the annealing time $t_{H2}$ is higher than 500 s, the niobium and titanium precipitates may coalesce, thereby inhibiting the hardening effect of Nb and Ti, and the austenite grains may be too large. As a result, the yield strength may exceed 450 MPa, the tensile strength of at least 780 MPa may not be obtained and/or a hole expansion ratio lower than 35% could be obtained.

The sheet is then cooled to a temperature $T_C$ comprised between 440° C. and 480° C., at a second cooling rate $V_{C2}$ comprised between 10° C./s and 50° C./s. During this cooling step, the austenite partly transforms into bainite and optionally ferrite.

This cooling may be done from the temperature $T_{H2}$ in one or more steps and may in the latter case involve different cooling modes, such as cold or boiling water bath, water jets or gas jets.

If the second cooling rate $V_{C2}$ is lower than 10° C./s, the final structure may comprise an excessive ferrite fraction and will comprise and insufficient martensite fraction and/or bainite fraction, so that the tensile strength will not reach 780 MPa and the hole expansion ratio will not reach 35%.

If the annealing temperature is comprised between Ac3 and Ac3+15° C., the second cooling rate $V_{C2}$ is preferably of at most 20° C./s, in order to transform part of the austenite into ferrite, so that the final structure comprises at least 10% of ferrite.

The steel sheet is then held in a temperature range comprised between 440° C. and 480° C. for a holding time $t_C$ comprised between 20 s and 500 s.

A partial transformation of the remaining austenite into bainite takes place at this stage. If the holding time to is shorter than 20 s, an insufficient fraction of bainite will form. If the holding time to is longer than 500 s, the bainite fraction will be too important, and the martensite fraction in the final structure insufficient.

Preferably, the holding time to is of at most 50 s.

Optionally, during the holding in the temperature range comprised between 440° C. and 480° C., the steel sheet is hot-dip coated in a zinc or zinc alloy bath at a temperature TZn lower than 480° C.

Optionally, after galvanizing, the steel sheet may be galvannealed, by heating immediately upon leaving the zinc or zinc alloy bath to a temperature $T_G$ comprised between 490 and 550° C. for a time $t_G$ generally comprised between 10 and 40 s.

Immediately after the holding in a temperature range comprised between 440° C. and 480° C., or after galvanizing or galvannealing, if performed, the sheet is cooled to ambient temperature, at a third cooling rate $V_{C3}$ of at least 1° C./s. During this cooling step, the remaining austenite transforms into fresh martensite and/or bainite.

With this manufacturing method, a cold-rolled and annealed steel sheet is obtained, the structure of which consists of, in surface fraction, between 34% and 80% of bainite, between 10% and 16% of martensite, and between 10% and 50% of ferrite. The surface fraction of unrecrystallized ferrite in the structure is of less than 30%. The martensite consists of self-tempered martensite and fresh martensite, the surface fraction of self-tempered martensite, with respect to the whole structure, being comprised between 4% and 10%.

After cooling down to the room temperature, if galvanizing was not performed, the cold-rolled and annealed steel sheet may be coated by vacuum deposition, for example by physical vapor deposition (PVD) or by jet vapor deposition (JVD) type.

The inventors have shown that the cold-rolled and annealed steel sheet produced by this manufacturing method have a tensile strength comprised between 780 and 900 MPa, a yield strength comprised between 350 and 450 MPa, a total elongation of at least 15%, or even at least 18%, and a hole expansion ratio HER of at least 35%.

The yield strength of between 350 and 450 MPa is achieved just after the cooling down to the room temperature, without performing any temper rolling.

Especially, the addition of niobium and titanium in the composition, and the precipitation of fine niobium and titanium carbonitrides during the annealing step allow obtaining a tensile strength of at least 780 MPa with a relatively low martensite fraction, of at most 16%. Hence, the yield strength remains of at most 450 MPa, and the difference in hardness between the components of the microstructure is reduced, so that the hole expansion ratio can exceed 35%.

Optionally, after cooling down to room temperature, a temper rolling is performed. In this case, the cold-rolled and annealed steel sheet has a tensile strength comprised between 780 and 900 MPa, a yield strength comprised between 450 and 550 MPa, a total elongation of at least 15%, or even 18%, and a hole expansion ratio HER of at least 35%.

The temper rolling is for example performed with a reduction ratio comprised between 0.1% and 0.4%, for example between 0.1% and 0.2%.

Besides, these mechanical properties are achieved over a wide range of thickness of the cold-rolled and annealed steel sheet, ranging from 0.7 mm to 2.3 mm. These properties are especially achieved when the thickness of the sheet is of at least 2.0 mm, up to 2.3 mm.

In addition, the mechanical properties, in particular the tensile strength, are homogeneous in the lengthwise and in the widthwise directions of the sheet. Especially, by considering the whole cold-rolled and annealed steel sheet, having a length, in the rolling direction, of at least 500 m, the difference in tensile strength between the highest tensile strength regions and the lowest tensile strength regions of the cold-rolled and annealed steel sheet is of at most 7% of the tensile strength of the highest tensile strength regions.

Examples

As examples and comparison, sheets made of steel compositions according to table I, have been manufactured, the elements being expressed by weight percent or by ppm (parts per million).

TABLE I

| Steel | C (%) | Mn (%) | Si (%) | Cr (%) | Nb (%) | Ti (%) | B (ppm) | P (%) | S (%) | Mo (%) | Al (%) | N (%) | Ac3 (° C.) |
|---|---|---|---|---|---|---|---|---|---|---|---|---|---|
| 1 | 0.077 | 1.9 | 0.25 | 0.3 | 0.021 | 0.019 | 18 | 0.015 | 0.001 | 0.002 | 0.021 | 0.005 | 825 |
| 2 | 0.082 | 2.2 | 0.25 | 0.3 | 0.025 | 0.024 | 19 | 0.015 | 0.001 | 0.002 | 0.019 | 0.006 | 813 |
| 3 | 0.082 | 2.2 | 0.40 | 0.3 | 0.025 | 0.024 | 20 | 0.015 | 0.001 | 0.002 | 0.018 | 0.006 | 816 |
| 4 | 0.074 | 2.0 | 0.25 | 0.5 | 0.024 | 0.025 | 20 | 0.014 | 0.002 | 0 | 0.028 | 0.006 | 828 |
| 5 | 0.110 | 2.2 | 0.27 | 0.6 | 0.021 | res | res | 0.015 | 0.002 | 0 | 0.024 | 0.005 | 805 |
| 6 | 0.102 | 2.5 | 0.27 | 0.3 | 0.020 | res | res | 0.015 | 0.001 | 0 | 0.032 | 0.007 | 804 |
| 7 | 0.108 | 2.8 | 0.23 | 0.04 | 0.031 | 0.022 | 14 | 0.015 | 0.001 | 0 | 0.040 | 0.006 | 803 |
| 8 | 0.082 | 2.0 | 0.25 | 0.5 | 0.024 | 0.033 | 17 | 0.014 | 0.002 | 0 | 0.020 | 0.007 | 821 |
| 9 | 0.069 | 2.0 | 0.23 | 0.5 | 0.025 | 0.030 | 15 | 0.013 | 0.002 | 0.043 | 0.020 | 0.006 | 832 |
| 10 | 0.149 | 1.9 | 0.21 | 0.2 | <0.002 | 0.022 | res | 0.021 | 0.001 | <0.002 | 0.025 | 0.004 | 798 |
| 11 | 0.070 | 2.0 | 0.26 | 0.5 | 0.025 | 0.025 | 21 | 0.016 | 0.001 | 0 | 0.024 | 0.007 | 828 |
| 12 | 0.086 | 2.0 | 0.27 | 0.5 | 0.025 | 0.025 | 20 | 0.016 | 0.001 | 0 | 0.023 | 0.007 | 821 |
| 13 | 0.074 | 2.1 | 0.26 | 0.5 | 0.016 | res | res | 0.016 | 0.001 | 0 | 0.03 | 0.006 | 821 |
| 14 | 0.072 | 2.0 | 0.04 | 0.2 | 0.010 | 0.008 | 7 | 0.016 | 0.001 | 0.198 | 0.575 | 0.005 | 896 |

In this table, "res" means that the corresponding element is present as a residual whose content is lower than the lower range defined for this element. Especially, residual amounts of Ti implies that the Ti content is below 3.42N, and residual amounts of B implies that the B content is below 0.0012%. The underlined values are not according to the present disclosure.

The transformation Ac3 values are also reported in table I. Ac3 was evaluated with the Thermo-Calc® software.

Steels having the compositions disclosed in Table I were cast so as to obtain ingots. The ingots were reheated at a temperature $T_{H1}$ of 1250° C., then hot-rolled, the final rolling temperature $T_{FRT}$ being comprised between Ar3 and $T_{NR}$, to obtain hot rolled steel sheets.

The hot-rolled steel sheets were cooled at a first cooling rate $V_{C1}$ of 30° C./s to a coiling temperature $T_{coil}$ and coiled at this temperature $T_{coil}$ to obtain a structure consisting of bainite and optionally martensite and/or pearlite, the surface fraction of pearlite being lower than 15%. For all the examples and comparative examples, the coiling temperature was above Mf.

The hot-rolled steels were then pickled and cold-rolled with a cold-rolling reduction ratio of 50%, to obtain cold-rolled sheets having a thickness of 1.4 mm.

The cold-rolled sheets were reheated to an annealing temperature $T_{H2}$ at an average heating rate $V_H$, and with an average heating rate $V_{H'}$ between 600° C. and Ac1, to an annealing temperature $T_{H2}$, and maintained at the annealing temperature $T_{H2}$ for an annealing time $t_{H2}$.

The sheets were then cooled at a second cooling rate $V_{C2}$ to a temperature $T_C$ and maintained at the temperature for a holding time $t_C$. The sheets were then galvanized by hot-dipping in a zinc bath at a temperature of at most 480° C. and cooled to the room temperature at a third cooling rate $V_{C3}$ of at least 1° C./s.

The sheets were finally temper-rolled with a temper rolling ratio comprised between 0.1 and 0.4%.

The conditions of treatment are reported in Table II.

TABLE II

| Ex. | Tcoil (° C.) | $V_H$ (° C./s) | $V_H'$ (° C./s) | Ac3−20° C. | Ac3+15° C. | $T_{H2}$ (° C.) | $t_{H2}$ (s) | $V_{C2}$ (° C./s) | $T_C$ (° C.) | $t_C$ (s) |
|---|---|---|---|---|---|---|---|---|---|---|
| 1-a | 450 | 6 | 2 | 805 | 840 | 790 | 59 | 24 | 470 | 27 |
| 1-b | 450 | 6 | 2 | 805 | 840 | 820 | 59 | 27 | 470 | 27 |
| 2-a | 450 | 6 | 2 | 793 | 828 | 790 | 59 | 24 | 470 | 27 |
| 2-b | 450 | 6 | 2 | 793 | 828 | 820 | 59 | 27 | 470 | 27 |
| 3-a | 450 | 6 | 2 | 796 | 831 | 790 | 59 | 24 | 470 | 27 |
| 3-b | 450 | 6 | 2 | 796 | 831 | 820 | 59 | 27 | 470 | 27 |
| 4-a | 450 | 6 | 2 | 808 | 843 | 790 | 59 | 24 | 470 | 27 |
| 4-b | 450 | 6 | 2 | 808 | 843 | 820 | 59 | 27 | 470 | 27 |
| 5-a | 450 | 6 | 2 | 785 | 820 | 790 | 59 | 24 | 470 | 27 |
| 5-b | 450 | 6 | 2 | 785 | 820 | 820 | 59 | 27 | 470 | 27 |
| 6-a | 450 | 6 | 2 | 784 | 819 | 790 | 59 | 24 | 470 | 27 |
| 6-b | 450 | 6 | 2 | 784 | 819 | 820 | 59 | 27 | 470 | 27 |
| 7-a | 450 | 6 | 2 | 783 | 818 | 790 | 59 | 24 | 470 | 27 |
| 7-b | 450 | 6 | 2 | 783 | 818 | 820 | 59 | 27 | 470 | 27 |
| 8-a | 450 | 6 | 2 | 801 | 836 | 790 | 59 | 24 | 470 | 27 |
| 8-b | 450 | 6 | 2 | 801 | 836 | 820 | 59 | 27 | 470 | 27 |
| 8-c | 550 | 6 | 2 | 801 | 836 | 800 | 53 | 29 | 470 | 24 |
| 8-d | 550 | 6 | 2 | 801 | 836 | 820 | 53 | 29 | 470 | 24 |
| 8-e | 550 | 7 | 2 | 801 | 836 | 830 | 53 | 29 | 470 | 24 |
| 8-f | 450 | 6 | 2 | 801 | 836 | 800 | 53 | 34 | 470 | 24 |
| 8-g | 450 | 6 | 2 | 801 | 836 | 820 | 53 | 29 | 470 | 24 |
| 8-h | 450 | 7 | 2 | 801 | 836 | 830 | 53 | 29 | 470 | 24 |
| 8-i | 450 | 6 | 2 | 801 | 836 | 820 | 53 | 29 | 550 | 24 |
| 8-j | 450 | 6 | 2 | 801 | 836 | 820 | 53 | 29 | 470 | 15 |
| 8-k | 450 | 6 | 20 | 801 | 836 | 820 | 53 | 29 | 470 | 27 |
| 9-m | 450 | 6 | 2 | 812 | 847 | 810 | 53 | 30 | 470 | 24 |
| 10-a | 450 | 6 | 2 | 778 | 813 | 790 | 59 | 24 | 470 | 27 |
| 10-b | 450 | 6 | 2 | 778 | 813 | 820 | 59 | 27 | 470 | 27 |
| 11-a | 450 | 6 | 2 | 808 | 843 | 790 | 59 | 24 | 470 | 27 |
| 11-b | 450 | 6 | 2 | 808 | 843 | 820 | 59 | 27 | 470 | 27 |
| 11-c | 550 | 6 | 2 | 808 | 843 | 800 | 53 | 29 | 470 | 24 |

TABLE II-continued

| Ex. | Tcoil (° C.) | $V_H$ (° C./s) | $V_H'$ (° C./s) | Ac3−20° C. | Ac3+15° C. | $T_{H2}$ (° C.) | $t_{H2}$ (s) | $V_{C2}$ (° C./s) | $T_C$ (° C.) | $t_C$ (s) |
|---|---|---|---|---|---|---|---|---|---|---|
| 12-a | 450 | 6 | 2 | 801 | 836 | 790 | 59 | 24 | 470 | 27 |
| 12-b | 450 | 6 | 2 | 801 | 836 | 820 | 59 | 27 | 470 | 27 |
| 12-c | 550 | 6 | 2 | 801 | 836 | 800 | 53 | 29 | 470 | 24 |
| 13-a | 450 | 6 | 2 | 801 | 836 | 790 | 59 | 24 | 470 | 27 |
| 13-b | 450 | 6 | 2 | 801 | 836 | 820 | 59 | 27 | 470 | 27 |
| 14-a | 450 | 6 | 2 | 876 | 911 | 790 | 59 | 24 | 470 | 27 |

In Table II, the underlined values are not according to the present disclosure. In Table II, the values of $T_{H2}$ which are not underlined are such that the structure upon annealing comprises at least 50% of austenite.

The microstructures of the steel sheets thus obtained were determined. The surface fraction of martensite (including tempered martensite and fresh martensite), the surface fraction of bainite and the surface fraction of low carbide containing bainite were quantified after etching with sodium bisulfite. The surface fraction of fresh martensite was quantified after etching by a NAOH-NaNO3 reagent.

The surface fraction of ferrite was also determined by optical and scanning electron microscopic observations, where the ferritic phase was identified and the fraction of unrecrystallized was determined by scanning electron microscopic observations after chemical polishing with a solution composed of hydrofluoric acid and hydrogen peroxide.

Furthermore, the mechanical properties of the sheets were determined.

Measured properties are the hole expansion ratio HER, the yield strength YS, the tensile stress TS, the uniform elongation UE and the total elongation TE.

The yield strength YS, the tensile strength TS, the uniform elongation UE and the total elongation TE were measured according to the ISO standard ISO 6892-1, published in October 2009. The hole expansion ratio HER was measured according to the standard ISO 16630:2009.

Besides, the difference ΔTS in tensile strength between the highest tensile strength regions and the lowest tensile strength regions of the sheets was measured.

The microstructures of the steel sheets and their mechanical properties are reported in table III below.

TABLE III

| Ex. | M (%) | FM (%) | TM (%) | B (%) | F (%) | UF < 30%? | LCB/B (%) | YS (MPa) | TS (MPa) | TE (%) | HER (%) | ΔTS (%) |
|---|---|---|---|---|---|---|---|---|---|---|---|---|
| 1-a | 10 | 8 | 2 | 30 | 60 | yes | 100 | 473 | 752 | 19 | 30 | 3 |
| 1-b | 10 | 8 | 2 | 33 | 57 | yes | 100 | 472 | 748 | 19 | 37 | 3 |
| 2-a | 20 | 16 | 4 | 31 | 49 | yes | 100 | 577 | 892 | 17 | 23 | 4 |
| 2-b | 25 | 15 | 10 | 30 | 45 | yes | 100 | 634 | 905 | 18 | 32 | 3 |
| 3-a | 18 | 14 | 4 | 27 | 55 | yes | 100 | 590 | 920 | 16 | 26 | 2 |
| 3-b | 23 | 13 | 10 | 25 | 52 | yes | 100 | 646 | 920 | 16 | 34 | 2 |
| 4-a | 12 | 10 | 2 | 45 | 43 | yes | 100 | 530 | 810 | 18 | 25 | 3 |
| 4-b | 12 | 8 | 4 | 50 | 38 | yes | 100 | 542 | 822 | 19 | 39 | 4 |
| 5-a | 19 | 15 | 4 | 20 | 61 | yes | 80 | 590 | 977 | 14 | 15 | 2 |
| 5-b | 14 | 9 | 5 | 28 | 58 | yes | 70 | 595 | 952 | 16 | 20 | 5 |
| 6-a | 22 | 18 | 4 | 22 | 56 | yes | 80 | 605 | 986 | 15 | 17 | 5 |
| 6-b | 14 | 9 | 5 | 33 | 53 | yes | 70 | 611 | 953 | 15 | 23 | 4 |
| 7-a | 16 | 14 | 2 | 25 | 59 | no | 70 | 585 | 836 | 16 | 24 | 3 |
| 7-b | 8 | 5 | 3 | 46 | 46 | yes | 80 | 562 | 761 | 14 | 29 | 2 |
| 8-a | 13 | 10 | 3 | 32 | 55 | yes | 100 | 490 | 795 | 16 | 30 | 4 |
| 8-b | 12 | 7 | 5 | 52 | 36 | yes | 100 | 530 | 835 | 17 | 42 | 3 |
| 8-c | 8 | 7 | 1 | 30 | 62 | yes | 100 | 450 | 741 | 19 | 40 | 12 |
| 8-d | 9 | 7 | 2 | 36 | 55 | yes | 100 | 470 | 751 | 20 | 31 | 11 |
| 8-e | 10 | 7 | 3 | 39 | 51 | yes | 100 | 497 | 774 | 18 | 35 | 9 |
| 8-f | 12 | 10 | 2 | 45 | 43 | yes | 100 | 490 | 800 | 18 | 29 | 3 |
| 8-g | 13 | 7 | 6 | 45 | 42 | yes | 100 | 500 | 795 | 18 | 41 | 3 |
| 8-h | 13 | 5 | 8 | 48 | 39 | yes | 100 | 545 | 816 | 15 | 45 | 2 |
| 8-i | 15 | 4 | 11 | 40 | 45 | yes | 100 | 572 | 845 | 15 | 32 | 4 |
| 8-j | 16 | 4 | 12 | 40 | 44 | yes | 100 | 584 | 835 | 16 | 33 | 2 |
| 8-k | 11 | 8 | 3 | 45 | 44 | no | 100 | 552 | 829 | 14 | 29 | 1 |
| 9-m | 13 | 10 | 3 | 32 | 55 | no | 100 | 556 | 809 | 17 | 38 | 2 |
| 10-a | 12 | 12 | 0 | 58 | 30 | yes | 70 | 503 | 807 | 20 | 27 | 6 |
| 10-b | 14 | 14 | 0 | 71 | 15 | yes | 60 | 560 | 821 | 16 | 34 | 2 |
| 11-a | 12 | 9 | 3 | 32 | 56 | yes | 100 | 494 | 792 | 16 | 27 | 3 |
| 11-b | 12 | 6 | 6 | 43 | 45 | yes | 100 | 497 | 788 | 19 | 37 | 2 |
| 11-c | 7 | 6 | 1 | 38 | 55 | yes | 100 | 442 | 738 | 19 | 41 | 8 |
| 12-a | 14 | 12 | 2 | 44 | 42 | yes | 100 | 488 | 826 | 18 | 24 | 2 |
| 12-b | 17 | 14 | 3 | 43 | 40 | yes | 100 | 520 | 846 | 16 | 27 | 3 |
| 12-c | 18 | 4 | 14 | 49 | 33 | yes | 100 | 635 | 882 | 11.8 | 42 | 8 |
| 13-a | 8 | 4 | 4 | 38 | 54 | yes | 100 | 412 | 753 | 20.1 | 33 | 4 |
| 13-b | 9 | 3 | 6 | 48 | 43 | yes | 100 | 407 | 750 | 19.7 | 37 | 3 |
| 14-a | 11 | 8 | 3 | 43 | 46 | no | 100 | 472 | 799 | 18.8 | 25 | 2 |

In Table III, M is the surface fraction of martensite, FM is the surface fraction of fresh martensite, TM is the surface fraction of tempered martensite, B is the surface fraction of bainite, F is the surface fraction of ferrite, the column "UF<30%" indicates whether the surface fraction of unrecrystallized ferrite is of less than 30%, and LBC/B is the percentage of bainite being low carbide containing bainite.

The composition of Steel 1 comprises less than 0.4% Cr, leading to an insufficient quenchability, so that the fraction of self-tempered martensite fraction does not reach 4%, whilst the ferrite fraction is higher than 50%. An even higher ferrite fraction is achieved for example 1-a, which is annealed at a temperature lower than Ac3−20° C. As a result, the tensile strength odes not reach 780 MPa and, for example 1-a, the hole expansion ratio does not reach 35%.

The composition of Steels 2 and 3 also comprise less than 0.4% Cr, and comprise more than 2.0% Mn. This high Mn content results in a too important stabilization of the austenite is, so that a too high martensite fraction forms during the cooling from the annealing temperature, and the bainite fraction is too low. As a result, the yield strength is too high. Besides, this Mn content higher than 2.0% leads to a banded structure, so that the hole expansion ratio does not reach 35%.

Figure 2:
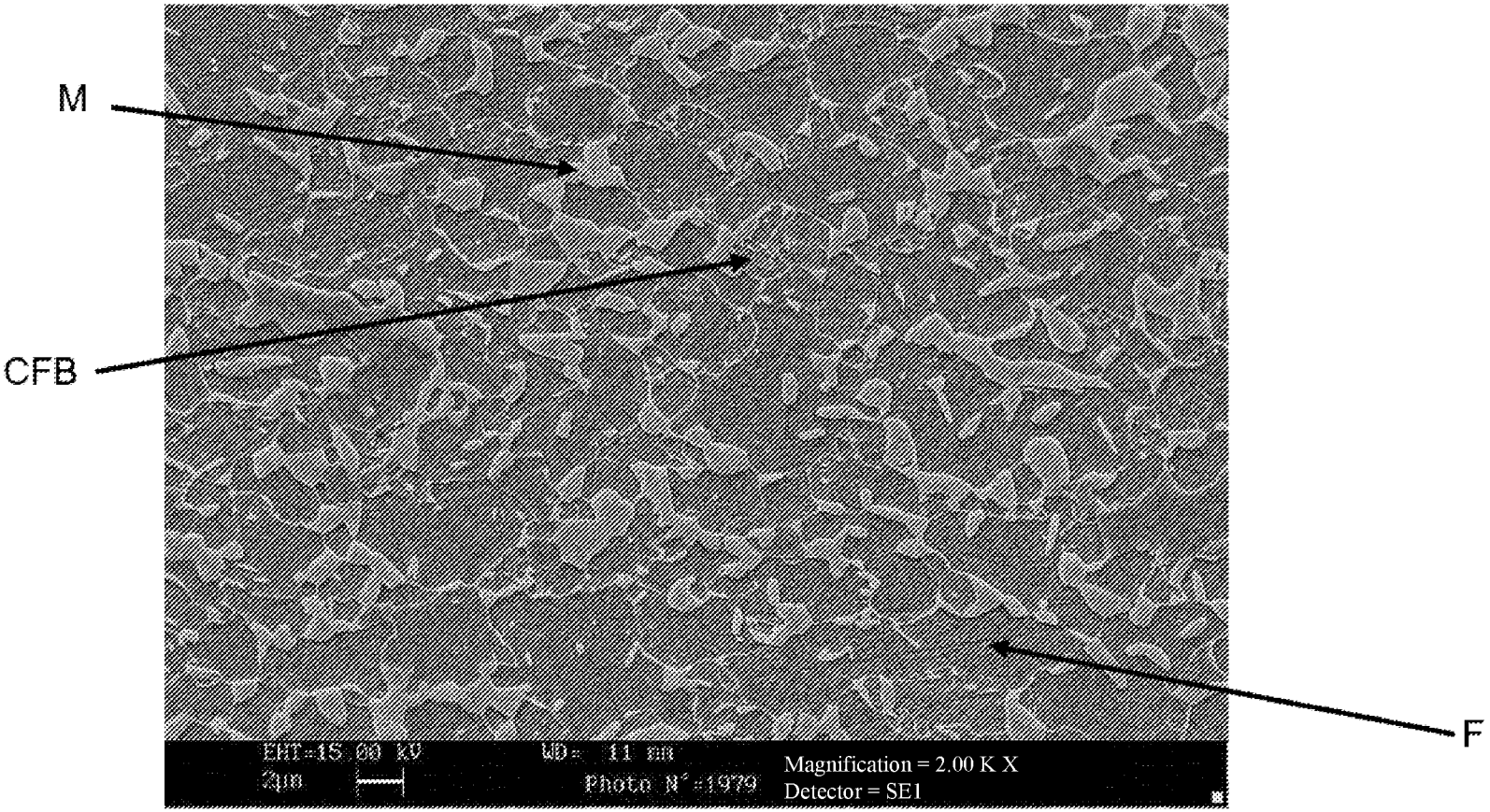
FIG. 2 is a micrograph showing the structure of a steel sheet in accordance with the present disclosure.

The composition of steel 4 is in accordance with the present disclosure. Example 4-b is produced by a method according to the present disclosure and has a structure according to the present disclosure, so that the targeted mechanical properties are reaches. FIG. 2 illustrates the structure of this example 4-b. On this Figure, M designates martensite, CFB designates carbides free bainite and F designates ferrite.

Example 4-a is, by contrast, annealed at a temperature $T_{H2}$ lower than $Ac_3$−20° C., so that the structure does not comprise enough self-tempered martensite, and the hole expansion ratio HER does not reach 35%.

The composition of steel 5 comprises too much C and Mn, and insufficient Ti and B contents. The composition of steel 6 comprises too much C and Mn, insufficient Ti and B contents and a too low Cr content. As a result, examples 5-a, 5-b, 6-a and 6-b do not have a structure as claimed, especially have too high ferrite fractions (ferrite being formed upon cooling) and too low bainite fractions, so that the yield strength is too high and the hole expansion ratio does not reach 35%.

The composition of steel 7 also comprises too much C and Mn, whilst the Cr content is too low and the Nb content too high. Example 7-a comprises too much ferrite, too much unrecrystallized ferrite and a too low bainite fraction, so that the targeted yield strength and hole expansion ratio are not achieved.

The composition of steel 8 is in accordance with the present disclosure. Examples 8-b, 8-g and 8-h were produced by a method according to the present disclosure and have a structure according to the present disclosure, so that the targeted mechanical properties are reached.

By contrast, examples 8-a was annealed at a temperature $T_{H2}$ lower than $Ac_3$−20° C., so that the structure does not comprise enough self-tempered martensite, not enough bainite and too much ferrite. As a result, the hole expansion ratio HER does not reach 35%.

Example 8-c, 8-d and 8-e were coiled at a too high coiling temperature. As a result, the structure does not comprise enough martensite, does not comprise enough self-tempered martensite, not enough bainite and too much ferrite. As a result, the tensile strength does not reach 780 MPa. In addition, the tensile strength is not uniform, the difference ΔTS in tensile strength being higher than 7%.

Example 8-f was annealed at a too low annealing temperature TH2, so that the structure contains too little self-tempered martensite, and the hole expansion ratio does not reach 35%.

Example 8-i was held at a too high temperature after annealing, so that the fraction of self-tempered martensite is too high, the yield strength is higher than 550 MPa and the hole expansion does not reach 35%.

Example 8-j was held for a too short holding time $t_c$. As a result, the transformation into bainite was incomplete, so that the fraction of self-tempered martensite is too high, the yield strength is higher than 550 MPa and the hole expansion does not reach 35%.

Example 8-k was heated with a too fast heating rate $V_H'$ to the annealing temperature. As a consequence, the structure comprises more than 30% unrecrystallized ferrite so that the hole expansion does not reach 35% and the yield strength is too high.

The composition of steel 9 comprises too much Mo, and example 9-m is annealed at a too low annealing temperature, so that the structure of the steel is not according to the present disclosure, and the targeted properties are not achieved.

The composition of steel 10 comprises too much C, not enough Cr, Nb and B. As a result, the martensite fraction is too high, and the hole expansion ratio does not reach 35%. FIG. 1 illustrates the structure of example 10-a. On this Figure, M designates martensite, CFB designates carbides free bainite and F designates ferrite. Besides, BC designates bainite containing carbides.

The composition of steel 11 is in accordance with the present disclosure. Example 11-b was produced by a method according to the present disclosure and have a structure according to the present disclosure, so that the targeted mechanical properties are reached.

By contrast, example 11-a was annealed at a temperature $T_{H2}$ lower than $Ac_3$−20° C., so that the structure does not comprise enough self-tempered martensite, not enough bainite and too much ferrite. As a result, the hole expansion ratio HER does not reach 35%.

Example 11-c was also annealed at a temperature $T_{H2}$ lower than $Ac_3$−20° C., and was additionally coiled at a too high coiling temperature. The structure does not comprise enough martensite nor enough self-tempered martensite and too much ferrite, so that the tensile strength odes not reach 780 MPa. In addition, the tensile strength is not uniform, the difference ΔTS in tensile strength being higher than 7%.

The composition of steel 12 includes more than 0.085% C. As a result, even if a method according to the present disclosure is performed, the targeted structure is not achieved, nor the targeted properties. Example 12-c again shows that coiling at a too high coiling temperature leads to a difference ΔTS in tensile strength higher than 7%.

The composition of steel 13 comprises too much Mn, and insufficient Ti and B contents. As a consequence, even if a method according to the present disclosure is performed, the targeted structure is not achieved, nor the targeted properties. Especially, owing to the insufficient Ti and B contents, the martensite fraction does not reach 10%, so that the tensile strength is lower than 780 MPa.

What is claimed is:

1. A cold-rolled and annealed steel sheet, having a composition comprising, by weight percent:

0.060%≤C≤0.085%
1.8%≤Mn≤2.0%
0.4%≤Cr≤0.6%
0.1%≤Si≤0.5%
0.010%≤Nb≤0.025%
3.42N≤Ti≤0.035%
0≤Mo≤0.030%
0.020%≤Al≤0.060%

0.0012%≤B≤0.0030%
S≤0.005%
P≤0.050%
0.002%≤N≤0.007% a remainder of the composition being iron and unavoidable impurities resulting from smelting, the cold-rolled and annealed steel sheet having a microstructure consisting of, in area fraction:

at least 34% and at most 80% bainite, at least 10% and at most 16% martensite, and at least 10% and at most 50% ferrite, wherein an area fraction of unrecrystallized ferrite in the ferrite, with respect to the whole microstructure, is less than 30%;

the martensite consisting of self-tempered martensite and fresh martensite, an area fraction of self-tempered martensite, with respect to the whole microstructure, being at least 4% and at most 10%, an area fraction of fresh martensite with respect to the whole microstructure, being 0% or more and at most 12%, wherein the cold-rolled and annealed steel sheet has a tensile strength TS of at least 780 MPa and at most 900 MPa, a yield strength YS of at least 350 MPa and at most 450 MPa, a total elongation TE of at least 15%, and a hole expansion ratio HER, measured according to ISO standard 16630:2009, of at least 35%.

2. The cold-rolled and annealed steel sheet according to claim 1, wherein the composition further comprises 0.0005%≤Ca≤0.005%.

3. The cold-rolled and annealed steel sheet according to claim 1, wherein said bainite consists of low carbide containing bainite, comprising less than 100 carbides per surface unit of 100 $\mu m^2$.

4. The cold-rolled and annealed steel sheet according to claim 1, wherein the cold-rolled and annealed steel sheet is non temper-rolled.

5. The cold-rolled and annealed steel sheet according to claim 1, wherein said cold-rolled and annealed steel sheet has a thickness of at least 0.7 mm and at most 2.3 mm.

6. The cold-rolled and annealed steel sheet according to claim 5, wherein said cold-rolled and annealed steel sheet has a thickness of at least 2.0 mm.

7. The cold-rolled and annealed steel sheet according to claim 1, having a length, in a rolling direction, of at least 500 m, a difference in tensile strength between highest tensile strength regions and lowest tensile strength regions of the cold-rolled and annealed steel sheet is of at most 7% of the tensile strength of the highest tensile strength regions.

8. The cold-rolled and annealed steel sheet according to claim 1, wherein the cold-rolled and annealed steel sheet comprises a zinc or zinc alloy coating, obtained through continuous dip coating.

9. The cold-rolled and annealed steel sheet according to claim 1, wherein the cold-rolled and annealed steel sheet comprises a zinc or zinc alloy coating, obtained through vacuum deposition.

10. The cold-rolled and annealed steel sheet according to claim 1, wherein the composition comprises 0.25%≤Si≤0.5%.

11. The cold-rolled and annealed steel sheet according to claim 1, wherein the tensile strength TS is of at least 780 MPa and at most 835 MPa.

12. A method for manufacturing the cold-rolled and annealed steel sheet of claim 1, comprising the following successive steps:

providing a semi-product made of a steel having a composition comprising, by weight percent:

0.060%≤C≤0.085%
1.8%≤Mn≤2.0%
0.4%≤Cr≤0.6%
0.1%≤Si≤0.5%
0.010%≤Nb≤0.025%
3.42N≤Ti≤0.035%
0≤Mo≤0.030%
0.020%≤Al≤0.060%
0.0012%≤B≤0.0030%
S≤0.005%
P≤0.050%
0.002%≤N≤0.007% a remainder of the composition being iron and unavoidable impurities resulting from smelting, heating said semi-product to a temperature $T_{H1}$ higher than or equal to 1200° C. then hot-rolling the heated semi-product, with a final rolling temperature $T_{FRT}$ between Ar3 and $T_{NR}$, Ar3 being a temperature of beginning of transformation of austenite upon cooling of the steel and $T_{NR}$ being a non-recrystallization temperature of the steel, to obtain a hot-rolled steel sheet, cooling the hot-rolled steel sheet at a first cooling rate $V_{C1}$ of at least 10° C./s to a coiling temperature $T_{coil}$ higher than a martensite finish temperature Mf of the steel and lower than 500° C., and coiling the hot-rolled steel sheet at the coiling temperature $T_{coil}$, to obtain a structure consisting of bainite or a structure consisting of bainite and martensite and/or pearlite, a surface fraction of pearlite being lower than 15%, cold-rolling the hot-rolled steel sheet with a cold-rolling reduction ratio of at least 40% to obtain a cold-rolled steel sheet, reheating the cold-rolled steel sheet to an annealing temperature $T_{H2}$ between Ac3-20° C. and Ac3+15° C., with an average heating rate $V_H$ to the annealing temperature $T_{H2}$ between 1° C./s and 50° C./s and an average heating rate $V_H'$, between 600° C. and $A_{C1}$, between 1° C./s and 10° C./s, and holding the cold-rolled steel sheet at the annealing temperature $T_{H2}$ for an annealing time $t_{H2}$ of at least 30 s, so as to obtain a structure comprising at least 50% of austenite, cooling the cold-rolled steel sheet to a temperature $T_C$ between 440° C. and 480° C., at a second cooling rate $V_{C2}$ between 10° C./s and 50° C./s, holding the cold-rolled steel sheet in a temperature range between 440° C. and 480° C. for a holding time to between 20s and 500s, cooling the cold-rolled steel sheet to ambient temperature at a third cooling rate $V_{C3}$ of at least 1° C./s.

13. The method according to claim 12, wherein the composition further comprises 0.0005%≤Ca≤0.005%.

14. The method according to claim 12, wherein the annealing time $t_{H2}$ is of at most 500 s.

15. The method according to claim 12, wherein the annealing temperature $T_{H2}$ is between Ac3 and Ac3+15° C. and the second cooling rate $V_{C2}$ is between 10° C./s and 20° C./s.

16. The method according to claim 12, wherein, during said holding in the temperature range of at least 440° C. and at most 480° C., the cold-rolled steel sheet is hot-dip coated in a bath at a temperature lower than or equal to 480° C.

17. The method according to claim 16, wherein the cold-rolled and annealed steel sheet is coated with Zn or a Zn alloy.

18. The method according to claim 12, wherein, after cooling down to the ambient temperature, a zinc or zinc alloy coating is performed by vacuum deposition.

19. The method according to claim 12, wherein the cold-rolling reduction ratio is between 40% and 80%.

* * * * *